US007315223B2

(12) United States Patent
Margomenos

(10) Patent No.: US 7,315,223 B2
(45) Date of Patent: Jan. 1, 2008

(54) MICROSTRIP-TO-MICROSTRIP RF TRANSITION INCLUDING CO-PLANAR WAVEGUIDE CONNECTED BY VIAS

(75) Inventor: Alex Margomenos, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 108 days.

(21) Appl. No.: 11/171,628

(22) Filed: Jun. 30, 2005

(65) Prior Publication Data

US 2006/0214744 A1 Sep. 28, 2006

Related U.S. Application Data

(60) Provisional application No. 60/584,328, filed on Jun. 30, 2004.

(51) Int. Cl.
*H01P 5/02* (2006.01)

(52) U.S. Cl. ..... 333/34; 333/262

(58) Field of Classification Search ..... 333/33, 333/246, 34, 262
See application file for complete search history.

(56) References Cited

U.S. PATENT DOCUMENTS

| | | | | |
|---|---|---|---|---|
| 5,994,983 | A * | 11/1999 | Andersson | 333/246 |
| 6,023,211 | A * | 2/2000 | Somei | 333/246 |
| 6,617,943 | B1 * | 9/2003 | Fazelpour | 333/204 |
| 2004/0119565 | A1 * | 6/2004 | Shirasaki | 333/246 |

* cited by examiner

*Primary Examiner*—Benny Lee
(74) *Attorney, Agent, or Firm*—John A. Miller; Miller IP Group, PLC

(57) ABSTRACT

A microstrip-to-microstrip RF transition circuit that employs a wide microstrip line transition to a short co-planar waveguide section. In one embodiment, a first microstrip line and a first ground plane are patterned on a top surface of a semiconductor wafer, and a second microstrip line and a second ground plane are patterned on a bottom surface of the wafer. A signal via is formed through the wafer and makes electrical contact with the first and second microstrip lines. Likewise, at least one ground via is formed through the wafer and makes electrical contact with the first and second ground planes. A widened portion of the microstrip line is positioned between extended portions of the respective ground plane so that a slot is provided between the widened portion and the extended portion.

15 Claims, 3 Drawing Sheets

MICROSTRIP-TO-MICROSTRIP RF TRANSITION INCLUDING CO-PLANAR WAVEGUIDE CONNECTED BY VIAS

CROSS REFERENCE TO RELATED APPLICATIONS

This application claims the benefit of the priority date of U.S. Provisional Patent Application No. 60/584,328, titled Microstrip-to-Microstrip RF Transition Including Co-Planar Waveguide, filed Jun. 30, 2004.

BACKGROUND OF THE INVENTION

1. Field of the Invention

This invention relates generally to a microstrip-to-microstrip RF transition circuit and, more particularly, to a microstrip-to-microstrip RF transition circuit for a semiconductor wafer that employs an RF microstrip to a co-planar waveguide (CPW) transition.

2. Discussion of the Related Art

Microelectro-mechanical switches (MEMS) used for RF applications is a technology area that has potential for providing a major impact on existing RF architectures in sensors and communications devices by reducing the weight, cost, size and power dissipation in these devices, possibly by a few orders of magnitude. Key devices for existing RF architectures include switches in radar systems and filters in communications systems. However, while MEMS technology has demonstrated the potential to revolutionize such devices, MEMS devices have not been specifically designed for performance in harsh environments, typically required for military applications, such as unmanned aerial vehicles (UAV) and national missile defense (NMD) systems. Particularly, MEMS technology requires further development in order to be able to provide effective performance under large temperature variations, strong vibrations and other extreme environmental conditions.

An appropriate packaging scheme that combines the properties of traditional high-speed packages and compatibility with planar technology offers a solution to this issue. Packaging is one of the most critical parts of the RF and MEMS fabrication process. Packaging is the most expensive step in the production line and will ultimately determine the performance and longevity of the device.

A large number of publications exist relating to RF MEMS based circuits, including phase shifters, single-pole multiple-through circuits, tunable filters, matching networks, etc. Many of these circuits have been designed based on a microstrip line configuration. Therefore, in order to develop a compatible on-wafer packaging scheme, a microstrip-to-microstrip transition needs to be provided. Such a transition for a MEMS is disclosed in U.S. Pat. No. 6,696,645 describing a coplanar waveguide (CPW)-to-CPW transition. The transition needs to be as broadband as possible, with minimum insertion loss and no parasitic resonance up to 50 GHz.

It is an important design consideration for a broadband microstrip-to-microstrip transition to maintain a characteristic impedance of the transition at 50Ω, especially at high frequency (>5 GHz). The 50Ω characteristic impedance through the transition is necessary to minimize signal reflections that would otherwise provide signal loss and degrade device performance. The design problem occurs because of the need for a wider microstrip line, which provides a lower impedance, in order to accommodate for the anisotropic etching of the vias through a semiconductor silicon wafer. When silicon is etched in potassium hydroxide or tetramethyl ammonia hydroxide, the etch rate of the <100> crystal plane is much higher than the etch rate of the <111> plane. This means that the final etched structure has a pyramidal shape found in the <111> planes of the silicon crystal. The angle between the <111> and the <100> planes is 54.74°. Other semiconductor wafer materials, such as GaAs, InP, etc., have similar anisotropic etching profiles. Therefore, in order to get a 20×20 μm square at the bottom of the via, a 160×160 μm square at the top of the via is required. This means that the width of the microstrip line needs to be at least 200 μm at the top of the via to accommodate for the size of the top of the vias. The wider microstrip line has a decreased characteristic impedance (approximately 25-30Ω). This mismatch increases the return loss of a back-to-back transition, thus reducing the overall bandwidth of the structure.

FIG. 1 is a perspective view of a microstrip transition circuit 10 that illustrates this problem. The transition circuit 10 includes an upper microstrip line 12, a lower microstrip line 14, an upper ground plane 16 and a lower ground plane 18. A top semiconductor wafer (not shown), such as a silicon wafer, would be provided between the microstrip line 12 and the ground plane 16 and a bottom semiconductor wafer (not shown), such as a silicon wafer, would be provided between the microstrip line 14 and the ground plane 18, both of which have been removed for clarity purposes. The microstrip line 12 is patterned on a top surface of the top semiconductor wafer, the upper ground plane 16 is patterned on the bottom surface of the top semiconductor wafer, the microstrip line 14 is patterned on the top surface of the bottom semiconductor wafer, and the lower ground plane 18 is patterned on the bottom surface of the bottom semiconductor wafer.

A signal via 20 is formed through the top semiconductor wafer and is in electrical contact with the microstrip lines 12 and 14. Two ground vias 22 and 24 are formed through the bottom semiconductor wafer and provide an electrical contact between the upper ground plane 16 and the lower ground plane 18. The vias 20, 22 and 24 have a "pyrmidical shape" from top to bottom because of the anisotropic etch rates through the crystal planes of silicon when the opening for the vias 20, 22 and 24 are formed, as discussed above. The microstrip lines 12 and 14 and the vias 20, 22 and 24 would be made of a suitable metal, as would be well understood to those skilled in the art.

Typically, the thickness of the semiconductor wafers is about 100 μm because this is the minimum wafer thickness for current wafer fabrication processes. It is desirable that the semiconductor wafers be as thin as possible so that the parasitic inductances generated by the vias 20, 22 and 24 is as minimal as possible. When the openings for the vias 20, 22 and 24 are etched for a wafer of this thickness, the timing of the etch produces about a 160×160 μm metallized square at the top end of the vias 20, 22 and 24 so that the etch produces about a 20×20 μm square at the bottom end of the vias 20, 22 and 24. The size of the top end of the vias 20, 22 and 24 ensures that the openings for the vias 20, 22 and 24 will be formed all the way through the thickness of the wafer.

The width of the microstrip line 12 is about 80 μm to provide the desired 50 Ω. However, a widened portion 26 of the microstrip line 20 that makes electrical contact with the top end of the via 20 is wider than the metallized square at the top of the via 20 to provide a suitable electrical contact and the proper orientation and alignment. For the dimensions being discussed herein, the width of the widened portion 26 would be between 200 and 220 μm. Because the wider portion 26 is wider than the rest of the microstrip line 12, it has a different characteristic impedance, typically 25-30Ω. A tapered transition 28 between the widened portion 26 and the rest of the microstrip line 12 minimizes reflections provided by the change in the characteristic impedance, but does not eliminate them. Thus, significant signal loss occurs at the transition between the microstrip line 12 and the via 20, especially at high frequencies. The microstrip line 14 includes the same size transition to a widened portion 46 at the bottom end of the via 20 so as to maintain the 25-30Ω characteristic impedance.

SUMMARY OF THE INVENTION

In accordance with the teachings of the present invention, a microstrip-to-microstrip RF transition circuit is disclosed that employs a wide microstrip line transition to a short co-planar waveguide section. In one embodiment, a first microstrip line and a first ground plane are patterned on a top surface of a semiconductor wafer, and a second microstrip line and a second ground plane are patterned on a bottom surface of the semiconductor wafer. A signal via is formed through the wafer and makes electrical contact with the first and second microstrip lines. Likewise, at least one ground via is formed through the wafer and makes electrical contact with the first and second ground planes. The microstrip lines include a widened portion where the microstrip line makes electrical contact with the signal via. The widened portion of the microstrip line is positioned between extended portions of the respective ground plane so that a slot is provided between the widened portion and the extended portion. The widened portion of the microstrip line and the slot between the ground plane defines a CPW, where the width of the widenend portion and the width of the slot is selected to provide a characteristic impedance equal to the characteristic impedance of the rest of the microstrip line.

Additional advantages and features of the present invention will become apparent from the following description and appended claims, taken in conjunction with the accompanying drawings.

DETAILED DESCRIPTION OF THE PREFERRED EMBODIMENTS

The following discussion of the embodiments of the invention directed to a microstrip-to-microstrip transition circuit employing a short CPW is merely exemplary in nature and is in no way intended to limit the invention or its applications or uses.

Figure 1:
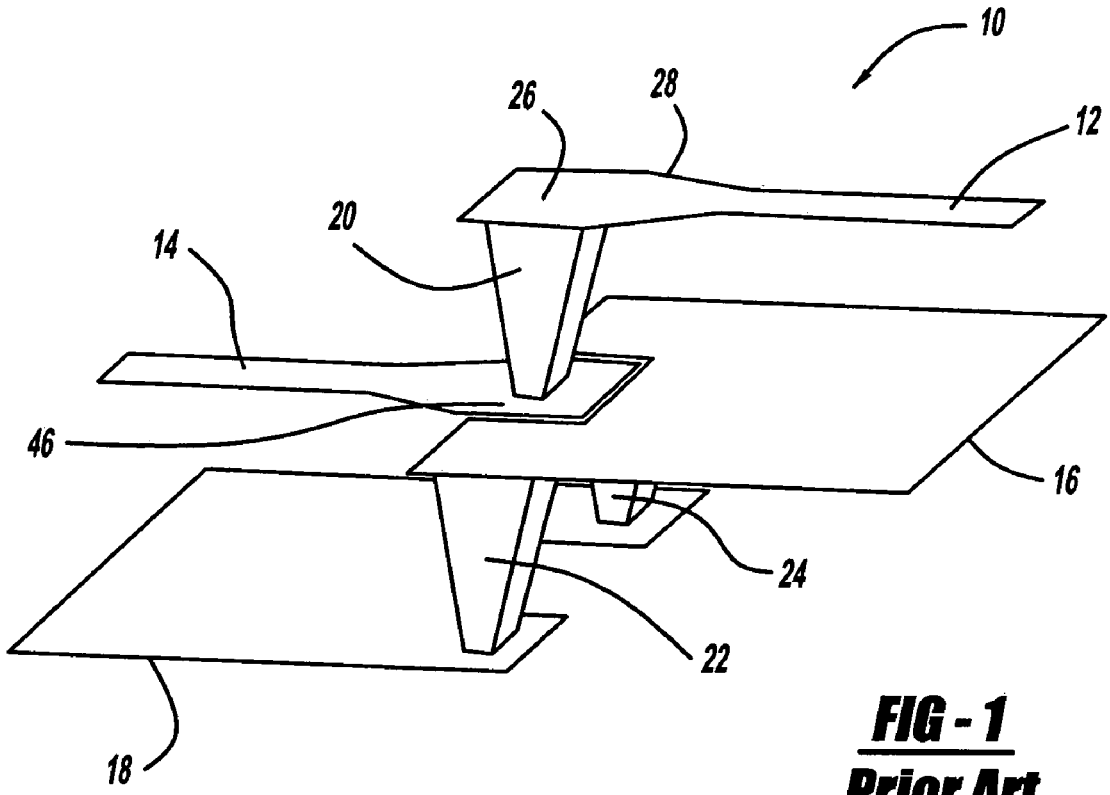
FIG - 1 Prior Art
FIG. 1 is a perspective view of a microstrip-to-microstrip transition circuit for an RF circuit of the type known in the prior art.
Figure 2:
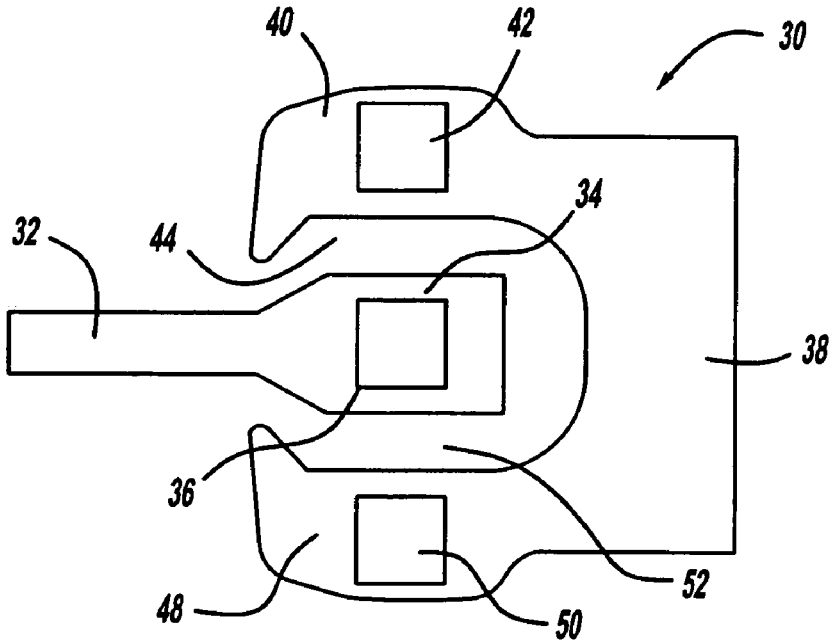
FIG. 2 is a top view of a microstrip transition circuit including a short CPW section, according to an embodiment of the present invention.

FIG. 2 is a top view of a microstrip transition circuit 30, according to one embodiment of the present invention. The transition circuit 30 includes a microstrip line 32 having a widened portion 34 electrically coupled to a signal via 36. The transition circuit 30 also includes a ground plane 38 having a first waveguide portion 40 electrically coupled to a first ground via 42, and defining an slot 44 between the portion 40 and the widened portion 34. The ground plane 38 also includes a second waveguide portion 48 electrically coupled to a second ground via 50, and defining an slot 52 between the waveguide portion 48 and the widened portion 34 of the microstrip line 32.

The combination of the waveguide portions 40 and 48 of the ground plane 38, the widened portion 34 of the microstrip line 32 and the slots 44 and 52 define a short CPW that has a certain characteristic impedance. The narrow portion of the microstrip line 32 has a characteristic impedance defined by the width of the microstrip line 32. The characteristic impedance of the CPW is defined by the width of the widened portion 34 and the width of the slots 44 and 52. The width of the widened portion 34 is defined by the diameter of the top end of the signal via 36, and the width of the slots 44 and 52 are selected so that the CPW has a characteristic impedance that matches the characteristic impedance of the narrow part of the microstrip line 32 for the width of the widened portion 34.

The CPW is wide enough to accommodate the anisotropic etching of the vias 36, 42 and 50. By utilizing this approach, the RF signal sees the minimum mismatch, and therefore the return loss can be kept below −10 dB for a wider bandwidth of operation.

After the via holes are etched, the co-planar waveguide ground planes are connected forming the microstrip ground plane, while the signal line transitions at the backside of the semiconductor wafer. This design can also be used for a microstrip line-to-co-planar waveguide transition because for some integrated RF circuits it is preferable to use a different type of interconnect on the inside and outside of the package.

Figure 3:
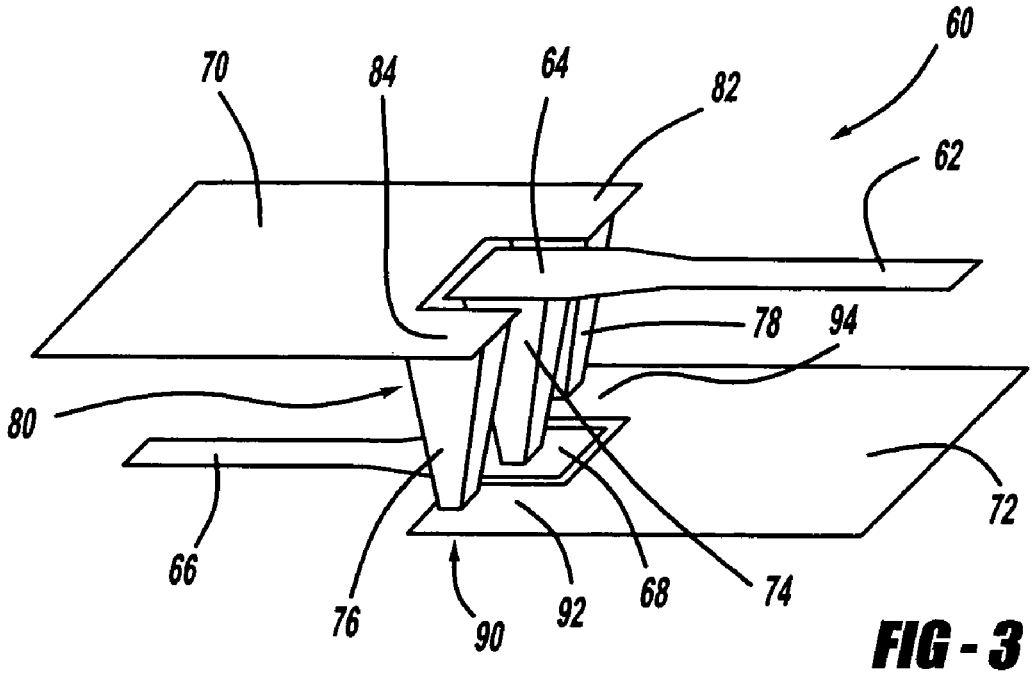
FIG. 3 is a perspective view of a microstrip-to-microstrip transition circuit for an RF circuit including CPW sections, according to another embodiment of the present invention.

FIG. 3 is a perspective view of a microstrip-to-microstrip transition circuit 60 employing CPWs of the type shown in FIG. 2, where the circuit 60 is comparable to the circuit 10. In this embodiment, only a single semiconductor wafer (not shown) is necessary. The semiconductor wafer can be silicon, GaAs, InP, silicon-germanium, etc. The circuit 60 includes an upper microstrip line 62 including a widened portion 64 patterned on the top surface of the semiconductor wafer, and a lower microstrip transition line 66 including a widened portion 68 patterned on the bottom surface of the semiconductor wafer. A top ground plane 70 is deposited on the top surface of the semiconductor wafer and a bottom ground plane 72 is deposited on the bottom surface of the semiconductor wafer. A signal via 74 is provided through the semicondcutor wafer and is in electrical contact with the widened portions 64 and 68 of the microstrip lines 62 and 66, respectively. Likewise, two ground vias 76 and 78 are provided through the semiconductor wafer and are in electrical contact with the top ground plane 70 and the bottom ground plane 72.

The circuit 60 further includes a first CPW 80 defined by the widened portion 64 of the microstrip transition line 62 and two extended portions 82 and 84 of the ground plane 70, and the slots therebetween. Likewise, the transition circuit 60 includes a second CPW 90 defined by the widened portion 68, two extended portions 92 and 94 of the ground plane 72, and the slots therebetween. The CPW 80 and the CPW 90 have an effective characteristic impedance that matches the characteristic impedance of the narrow portion of the microstrip lines 62 and 66. Therefore, signals propagating on the microstrip lines 62 and 66 and through the wafer have a minimal return loss. In one embodiment, the characteristic impedance is 50Ω.

Figure 4:
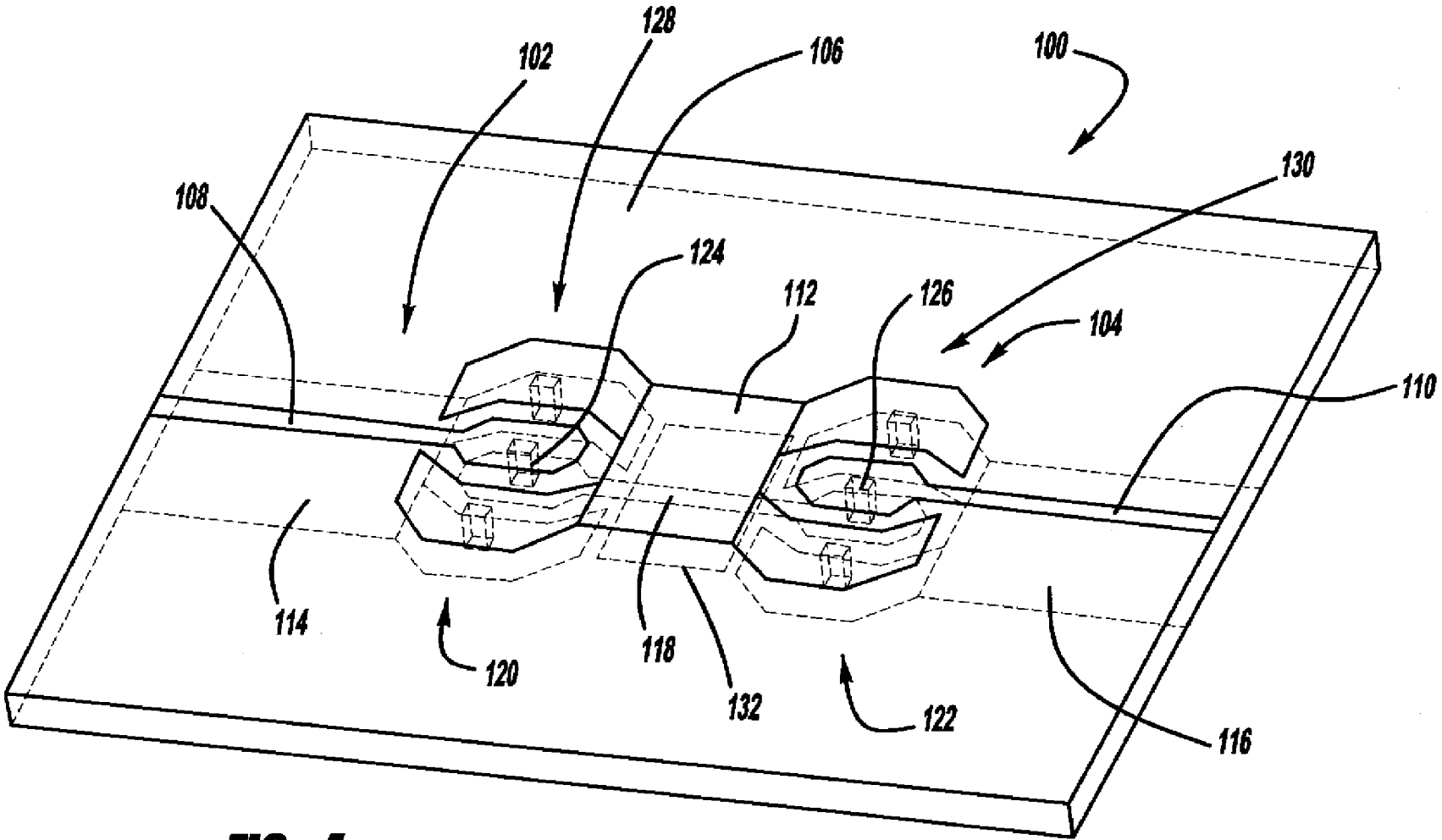
FIG. 4 is a perspective view of a microstrip-to-microstrip transition circuit, according to another embodiment of the present invention.

FIG. 4 is a perspective view of an RE circuit 100 employing two back-to-back microstrip transition circuits 102 and 104 of the type shown in FIG. 3. In this embodiment, a silicon wafer 106 is shown as part of the circuit 100. A first microstrip transition line 108, a second microstrip transition line 110 and a first ground plane 112 are patterned on a top surface of the wafer 106. A second ground plane 114, a third ground plane 116 and a third microstrip line 118 are patterned on a bottom surface of the wafer 106. Four CPWs 120, 122, 128 and 130 transfer the signal from the microstrip line 108 to the microstrip line 118 and then to the microstrip line 110 in the manner as discussed above through signal vias 124 and 126.

One advantage of the design of the present invention is that in the case of an on-wafer packaging architecture, the ground plane of the microstrip can be used for forming a sealing ring. This means that the ring will always be connected to the RF line, and therefore the parasitic resonance due to its length will be reduced or even eliminated. Moreover, because most of the developed RF MEMS are suspended over microstrip lines, this proposed packaging architecture can be of great interest in the industry. In order to illustrate such a configuration, a MEMS 132 is shown formed relative to the wafer 106 and suspended relative to the microstrip line 118.

Figure 5:
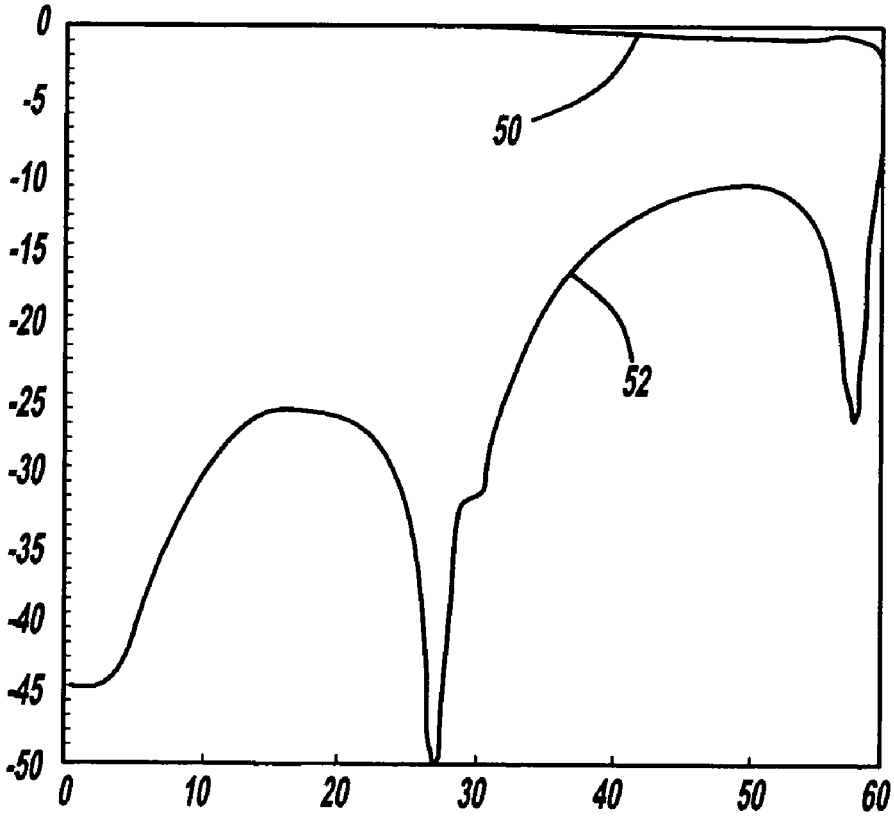
FIG. 5 is a graph with frequency on the horizontal axis and S-parameters on the vertical axis showing transition and reflection losses for the microstrip-to-microstrip transition circuit shown in FIG. 4.

FIG. 5 is a graph with frequency on the horizontal axis and S-parameters on the vertical axis showing the insertion and return loss for the circuit 10 at line 50 and the return loss at line 52.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An RF circuit comprising:

a wafer including a first surface and a second surface;

a first microstrip line deposited on the first surface of the wafer, said first microstrip line including a widened portion;

a first ground plane deposited on the first surface of the wafer, said first ground plane including a first extended section and a second extended section adjacent to the widened portion of the first microstrip line and defining a slot therebetween, wherein the first and second extended portions of the first ground plane, the widened portion of the first microstrip line and the slot therebetween define a first co-planar waveguide having a characteristic impedance;

a second microstrip line deposited on the second surface of the wafer, said second microstrip line including a widened portion;

a second ground plane deposited on the second surface of the wafer, said second ground plane including a first extended section and a second extended section adjacent to the widened portion of the second microstrip line and defining a slot therebetween, wherein the first and second extended sections of the second ground plane, the widened portion of the second microstrip line and the slot therebetween define a second co-planar waveguide having a characteristic impedance;

a signal via extending through the wafer and being electrically coupled to the widened portion of the first microstrip line and the widened portion of the second microstrip line;

at least one ground via extending through the wafer and being electrically coupled to the first ground plane and the second ground plane, wherein the characteristic impedance of the first co-planar waveguide and the second co-planar waveguide provide a substantially constant characteristic impedance between the first microstrip line and the second microstrip line; and a micro-electromechanical switch formed to the wafer relative to the second microstrip line.

2. The circuit according to claim 1 wherein the at least one ground via is a first ground via electrically coupled to the first extended section of the first ground plane and the first extended section of the second ground plane and a second ground via electrically coupled to the second extended section of the first ground plane and the second extended section of the second ground plane.

3. The circuit according to claim 1 wherein the characteristic impedance is about 50Ω.

4. The circuit according to claim 1 wherein the first and second microstrip lines extend in opposite directions from the co-planar waveguide and the first and second ground planes extend in opposite directions from the co-planar waveguide.

5. The circuit according to claim 1 wherein the wafer is a semiconductor wafer selected from the group consisting of silicon, GaAs, InP, and silicon-germanium wafers.

6. The circuit according to claim 1 wherein the first microstrip line and the second microstrip line each include a narrow portion and a tapered portion between the narrow portion and the widened portion.

7. An RF circuit comprising:

a substrate including a first surface and a second surface;

a first microstrip line deposited on the first surface of the substrate, said first microstrip line including a narrow portion, a widened portion and a tapered transition therebetween;

a second microstrip line deposited on the first surface of the substrate, said second microstrip line including a narrow portion, a widened portion and a tapered transition therebetween;

a third microstrip line deposited on the second surface of the substrate, said third microstrip line including a first end and a second end, said first end of the third microstrip line including a narrow portion, a widened portion and a tapered transition therebetween and said second end of said third microstrip line including a narrow portion, a widened portion and a tapered transition therebetween;

a first ground plane deposited on the first surface of the substrate, said first ground plane including a first end and a second end, said first end of the first ground plane including a first extended section and a second extended section positioned adjacent to the widened portion of the first microstrip line and defining a slot therebetween, wherein the first and second extended sections of the first end of the first ground plane, the widened portion of the first microstrip line and the slot therebetween define a first co-planar waveguide having a characteristic impedance, said second end of the first ground plane including a first extended section and a second extended section positioned adjacent to the widened portion of the second end of the second microstrip line and defining a slot therebetween, wherein the first and second extended sections of the second end of the first ground plane, the widened portion of the second microstrip line and the slot therebetween define a second co-planar waveguide having a characteristic impedance;

a second ground plane deposited on the second surface of the substrate, said second ground plane including a first extended section and a second extended section positioned adjacent to the widened portion of the first end of the third microstrip line and defining a slot therebetween, wherein the first and second extended sections of the second ground plane, the widened portion of the first end of the third microstrip line and the slot therebetween define a third co-planar waveguide having a characteristic impedance;

a third ground plane deposited on the second surface of the substrate, said third ground plane including a first extended section and a second extended section positioned adjacent to the widened portion of the second end of the third microstrip line and defining a slot therebetween, wherein the first and second extended sections of the third ground plane, the widened portion of the second end of the third microstrip line and the slot therebetween define a fourth co-planar waveguide having a characteristic impedance, wherein the second ground plane and the third ground plane are spaced from each other so that no ground plane is present on the second surface adjacent to a substantial length of the third microstrip line;

a first signal via extending through the substrate and being electrically coupled to the widened portion of the first microstrip line and the widened portion of the first end of the third microstrip line;

a second signal via extending through the substrate and being electrically coupled to the widened portion of the second microstrip line and the widened portion of the second end of the third microstrip line; and at least one ground via extending through the substrate and being electrically coupled to the first ground plane and the second ground plane and at least one ground via extending through the substrate and being electrically coupled to the first ground plane and the third ground plane, wherein the characteristic impedance of the first, second, third and fourth co-planar waveguide provide a substantially constant characteristic impedance between the first, second and third microstrip lines.

8. The circuit according to claim 7 wherein the substrate is a semiconductor substrate selected from the group consisting of silicon, GaAs, InP, and silicon-germanium, substrates.

9. The circuit according to claim 7 wherein the circuit includes a micro-electromechanical switch.

10. The circuit according to claim 7 wherein the at least one ground via electrically coupled to the first ground plane and the second ground plane includes a first ground via electrically coupled to the first extended section of the first end of the of the first ground plane and the first extended section of the second ground plane, a second ground via electrically coupled to the second extended section of the first end of the first ground plane and the second extended section of the second ground plane, and wherein the at least one ground via electrically coupled to the first ground plane and the third ground plane includes a first ground via electrically coupled to the first extended section of the second end of the first ground plane and the first extended section of the third ground plane and a second ground via electrically coupled to the second extended section of the second end of the first ground plane and the second extended section of the third ground plane.

11. The circuit according to claim 7 wherein the characteristic impedance is about 50Ω.

12. An RF circuit comprising:

a substrate including a first surface and a second surface;

a first microstrip line deposited on the first surface of the substrate, said first microstrip line including a narrow portion, a widened portion and a tapered transition therebetween;

a first ground plane deposited on the first surface of the substrate, said first ground plane including a first extended section and a second extended section positioned adjacent to the widened portion of the first microstrip line and defining a slot therebetween, wherein the first and second extended sections of the first ground plane, the widened portion of the first microstrip line and the slot therebetween define a co-planar waveguide having a characteristic impedance, and wherein the characteristic impedance of the co-planar waveguide is substantially the same as the characteristic impedance of the narrow portion of the first microstrip line;

a signal via extending through the substrate and being electrically coupled to the widened portion of the first microstrip line;

a second microstrip line deposited on a second surface of the substrate, said signal via being electrically coupled to the second microstrip line; and a micro-electromechanical switch formed to the substrate relative to the second microstrip line.

13. The circuit according to claim 11 wherein the substrate is a semiconductor substrate selected from the group consisting of silicon, GaAs, InP, and silicon-germanium substrates.

14. The circuit according to claim 12 further comprising a second ground plane deposited on the second surface of the substrate and first and second ground vias, wherein the first ground via is electrically coupled to the first extended section of the first ground plane and the second ground plane and the second ground via is electrically coupled to the second extended section of the first ground plane and the second ground plane.

15. The circuit according to claim 12 wherein the characteristic impedance os about 50Ω.

* * * * *